United States Patent [19]

Chevalier et al.

[11] Patent Number: 4,957,097

[45] Date of Patent: Sep. 18, 1990

[54] FOAM INSULATED VESSEL AND METHOD OF MAKING THE SAME

[75] Inventors: James L. Chevalier, Mequon; John D. Pfeffer, Brookfield; Thomas F. Brownell, Oconomowoc, all of Wis.

[73] Assignee: AOS Holding Company, Wilmington, Del.

[21] Appl. No.: 157,320

[22] Filed: Feb. 18, 1988

[51] Int. Cl.[5] ..... F24H 1/00

[52] U.S. Cl. ..... 126/373; 126/361; 220/444

[58] Field of Search ..... 126/373, 361, 344; 264/46.7, 46.9, 45.2; 29/455.1, 460; 220/444, 446, 447, 445, 430, 431, 432, 433, 68, 70

[56] References Cited

U.S. PATENT DOCUMENTS

| | | | |
|---|---|---|---|
| 1,689,935 | 10/1928 | Shuell | 122/234 X |
| 4,296,799 | 10/1981 | Steele | 126/437 |
| 4,372,028 | 2/1983 | Clark | 29/460 |
| 4,477,399 | 10/1984 | Tilton | 264/45.2 |
| 4,527,543 | 7/1985 | Denton | 126/344 X |
| 4,628,184 | 12/1986 | West | 264/46.7 |
| 4,736,509 | 4/1988 | Nelson | 29/451 |
| 4,749,532 | 6/1988 | Pfeffer | 264/46.5 |

*Primary Examiner*—Larry Jones

*Attorney, Agent, or Firm*—Andrus, Sceales, Starke & Sawall

[57] ABSTRACT

A foam insulated vessel, such as a water heater. The water heater includes a tank to contain water to be heated and a jacket is spaced outwardly of the tank to provide an annular cavity therebetween. An annular flexible strip is secured to the surface of one of said members, and is in sealing relation with the other of said members, thus forming a closure or dam at the lower end of the cavity. In a preferred form, the strip includes a flange secured to the tank and a body portion extends outwardly from the flange and terminates in a downwardly extending lip, which is located at an acute angle with respect to the body portion. The lip is in sealing engagement with the jacket. When a liquid foamable resin is introduced into the upper end of the cavity, the pressure acts to force the body portion of the seal downwardly, increasing the sealing effect against the jacket to retain the liquid resin within the cavity.

5 Claims, 1 Drawing Sheet

FIG. 1.
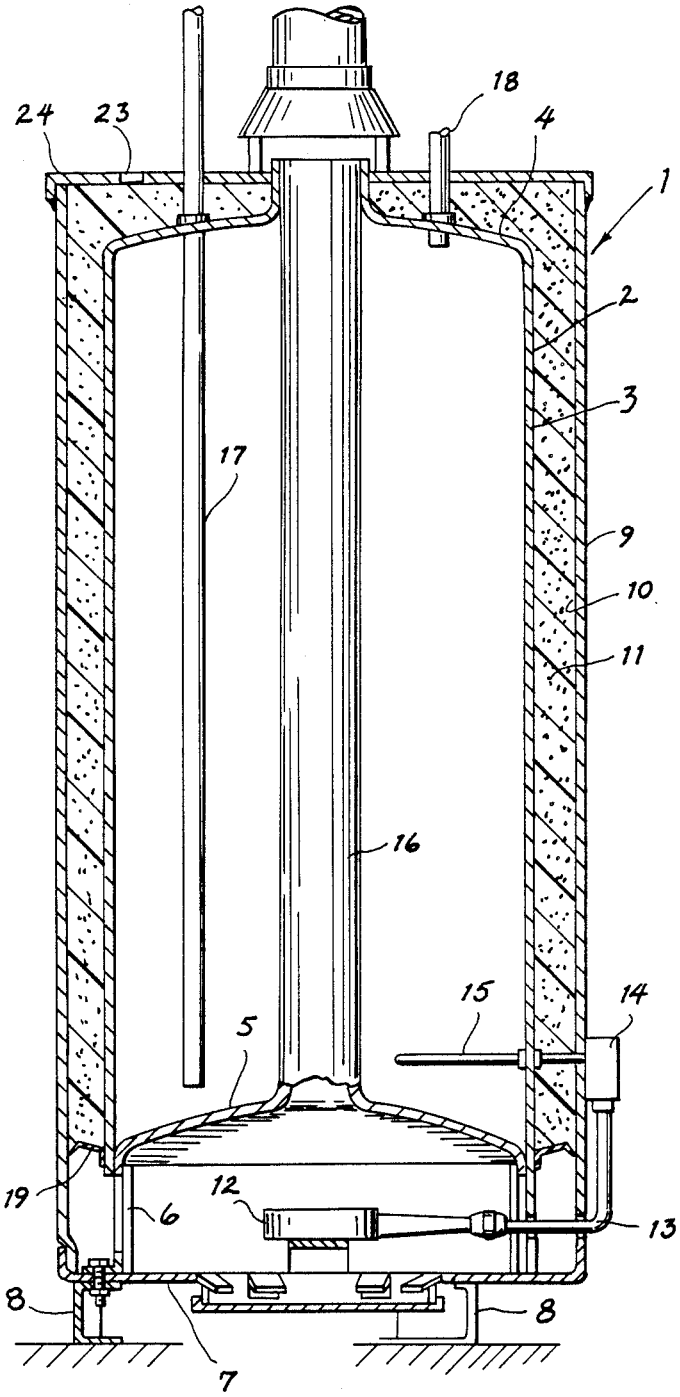
FIG. 2
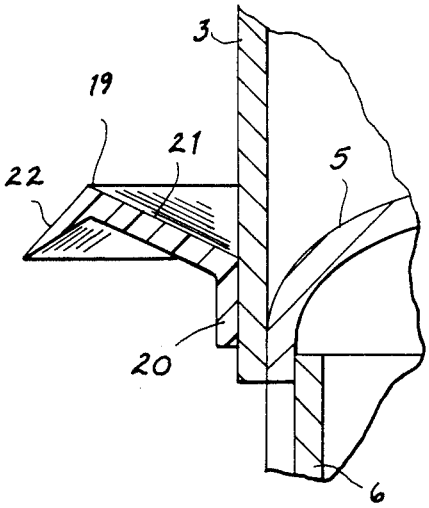
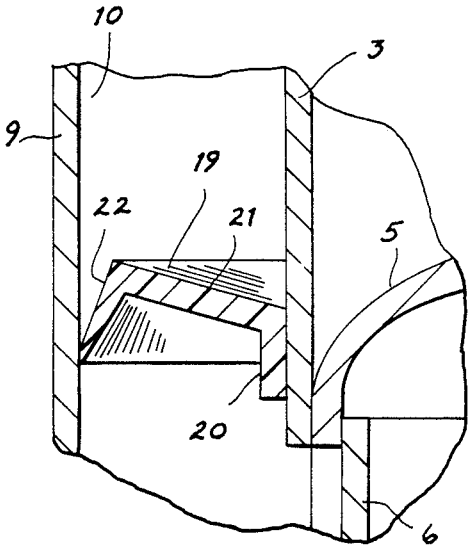
FIG. 3.

FOAM INSULATED VESSEL AND METHOD OF MAKING THE SAME

BACKGROUND OF THE INVENTION

The typical water heater includes a tank to contain water to be heated and a jacket is spaced outwardly of the tank to provide an annular cavity therebetween. To insulate the tank, a layer of insulating material, which can take the form of fiber glass or a foam resin material, such as polyurethane foam, is located in the cavity.

When insulating a tank with a foamed resin composition, a liquid resin is introduced into the upper end of the cavity and expands outwardly to fill the cavity and provide an insulating layer. In one method of providing the foamed insulated water heater, as disclosed in U.S. Pat. No. 4,628,184, a bag formed of polyethylene film and having a closed bottom is disposed within the cavity and the liquid resin is introduced into the bag. With this method, the bag contains the liquid resin and prevents the liquid from leaking from the cavity.

In other methods of producing a foam insulated water heater, a dam or closure is positioned at the lower end of the cavity to retain the liquid resin, as it is introduced into the cavity. In accordance with the method of U.S. Pat. No. 4,477,399 an inflatable annular ring is located at the lower end of the cavity, and by introducing gas into the ring, the ring will extend radially to form a dam or closure at the lower end of the cavity. In U.S. Pat. No. 4,372,028, an annular bag is positioned at the lower end of the cavity and the bag is filled with a liquid foamable resin composition. The resin expands outwardly within the bag to provide a collar or dam at the lower end of the cavity.

The use of an inflatable bag is a relatively expensive procedure, particularly if the bag is not removed and is retained in the fully assembled water heater. On the other hand, removal of the bag for reuse is difficult, even if release agents are utilized, because of the tendency of the liquid resin composition to bond firmly to areas that are not adequately coated with the release agent.

It has also been proposed to seal or close off the lower end of the cavity between the tank and the jacket through use of a fiber glass ring. However, a fiber glass ring, if not properly installed, may not provide a positive seal and the pressure of the expanding resin within the cavity may cause the fiber glass ring to shift or migrate during the foaming operation.

SUMMARY OF THE INVENTION

The invention is directed to a foam insulated vessel, such as a water heater and to a method of producing the foam insulated vessel. A jacket is spaced outwardly of the water heater tank, and in accordance with the invention, a strip of a flexible material is applied to the outer surface of the tank, or alternately to the inner surface of the jacket, and bridges the lower end of the cavity between the tank and the jacket.

The strip includes an annular longitudinally extending flange, which can be secured to the outer surface of the tank by an adhesive or a clamping mechanism and a body portion extends laterally from the flange at an upward angle. The outer portion of the body terminates in a downwardly extending lip which is at an acute angle with respect to the body.

With the strip secured to the outer surface of the tank, the jacket is assembled around the tank causing the jacket to ride against the outer end of the lip, deforming the lip and providing a seal between the lip and the inner surface of the jacket.

A liquid foamable resin composition is then introduced into the upper end of the cavity and the strip serves as a dam to contain the liquid resin. The liquid resin expands to fill the cavity and provide an insulating layer between the jacket and the tank.

The strip provides a simple and inexpensive manner of obtaining a dam or closure at the lower end of the cavity. The engagement of the lip with the jacket provides a positive seal, and the pressure of the liquid resin composition during the foaming operation acts against the body portion of the seal to urge the lip against the jacket surface to increase the integrity of the seal.

The strip can be applied to either the jacket or the tank and may be positioned anywhere along the length of the tank depending upon the tank construction. Further, the dam forming strip can be utilized in producing either foam insulated gas-fired or electric water heaters or any other type of foam insulated vessel.

Other objects and advantages will appear in the course of the following description.

DESCRIPTION OF THE DRAWINGS

The drawings illustrate the best mode presently contemplated of carrying out the invention.

In the drawings:

FIG. 1 is a longitudinal section of a water heater incorporating the invention;

FIG. 2 is an enlarged fragmentary longitudinal section showing the strip as applied to the water heater tank before assembly of the outer jacket; and FIG. 3 is a view similar to FIG. 2 after the assembly of the jacket.

DESCRIPTION OF THE ILLUSTRATED EMBODIMENT

FIG. 1 illustrated a typical gas-fired water heater 1 that includes a steel tank 2 to contain water to be heated. Tank 2 includes a generally cylindrical shell 3, which is enclosed at its upper end by an upper head 4 and at its lower end by a lower head 5.

Skirt 6 extends downwardly from the lower end of the tank and supports the tank above base 7, which in turn, is supported from the ground, or other foundation, by a plurality of legs 8.

Surrounding tank 2 is a cylindrical jacket 9 and the jacket is spaced outwardly of the tank to provide an annular space or cavity 10 therebetween, which, in the completed state of the water heater, contains a foam resin insulating material 11.

Water within tank 2 is heated by a burner 12, which is located beneath lower head 5, and a gas fuel is fed to the burner through a supply line 13. The flow of the gas through line 13 is controlled by a conventional control valve 14 which, in turn, is operated by a thermostat 15 that is responsive to the water temperature.

The waste gases of combustion generated by ignition of the fuel-air mixture are conducted upwardly through the tank through one or more vertical flues 16. As illustrated, the lower end of flue 16 is secured within an opening in lower head 5, while the upper end of the flue is secured within an aligned opening in upper head 4. A suitable baffling arrangement, not shown, can be incorporated with the flue 16 to increase the heat transfer from the waste gases of combustion to the water in tank 2.

The inner surface of tank 2, as well as the outer surface of flue 16 can be coated with a conventional corrosion resistant coating, not shown, such as glass or vitreous enamel.

Water is introduced into the lower end of tank 2 through a dip tube 17 and heated water is withdrawn from the upper end of the tank through an outlet 18.

As illustrated in the drawings, a flexible strip 19 is applied to the outer surface of shell 3 adjacent the lower end of the tank. Strip 19 is a relatively flexible material and can be formed of plastic, rubber, or metallic materials. Strip 19 is cylindrical in shape completely encircling the tank 2 and the ends of the strip can either be in overlapping or abutting relation.

As best illustrated in FIG. 2, strip 19 includes a longitudinal flange 20, which is secured to the outer surface of tank 2, preferably through use of an adhesive, or alternately, through use of a mechanical clamping band. A body portion 21 extends outwardly from flange 20 at an upward angle and the outer portion of body 21 terminates in a downwardly extending lip 22, which is at an acute angle with respect to the body 21.

As jacket 9 is assembled downwardly around tank 2, the jacket will ride against the outer end of lip 22 forcing the lip downwardly, as shown in FIG. 3. The natural reslience in the strip 19 will thus urge the body 21 and lip 22 upwardly to provide a firm seal between lip and the inner surface of jacket 9.

With the jacket 9 assembled around tank 2, a conventional liquid foamable resin composition is introduced into the upper end of cavity 10 through an opening 23 in the jacket cover 24. Strip 19 will retain the liquid resin in the cavity and the resin will expand to fill the cavity and provide the insulating layer 11 between the tank 2 and jacket 9.

While the drawings illustrate strip 19 being applied to the outer surface of tank 2, it is apparent that the strip could also be applied to the inner surface of jacket 9, in which case the lip 22 will bear against the outer surface of tank shell 3 to provide the dam or closure for the lower end of the cavity 10.

Depending on the nature of the tank, and the location of the tank components, such as the thermostat drain valve and the like, the strip 19 can be applied anywhere along the length of the tank 2 or jacket 9.

Similarly, it is contemplated that the strip 19 can be applied to either the tank 2 or jacket 9 after the jacket is assembled with the tank. In this case, the strip would be inserted into the lower end of the cavity 10 and secured to either the tank surface or the jacket surface.

The drawings illustrate the invention applied to a gas-fired water heater, but the invention can also be adapted to an electric water heater or any other foam insulated vessel.

Various modes of carrying out the invention are contemplated as being within the scope of the following claims particularly pointing out and distinctly claiming the subject matter which is regarded as the invention.

We claim:

1. A foam insulated vessel, comprising a tank member to contain a fluid, a jacket member spaced outwardly of said tank member to provide an annular cavity therebetween, a flexible relatively stiff annular sealing strip disposed within said cavity, and aperture means at one end of said cavity for introducing a liquid foamable resin into said cavity, said strip having one edge secured to a first of said members and having a second distal edge disposed in sliding contact with the second of said members to provide a seal for said cavity, the central portion of said strip between said edges being arched in a direction toward said aperture means, said liquid foamable resin being supported by said strip to enable said liquid resin to expand to substantially fill said cavity and provide an insulating layer between said tank member and said jacket member, said strip being constructed and arranged such that the pressure exerted by said foamable resin against said arched central portion will urge said distal edge into tight engagement with said second member.

2. A foam insulated vessel, comprising a tank member to contain a fluid, a jacket member spaced outwardly of said tank member to provide an annular cavity therebetween, a stiff flexible annular sealing strip disposed within said cavity, said strip having a longitudinal extending flange secured to a first of said members and said strip having a body portion extending radially of said flange having an outer lip disposed at an angle to said body portion and disposed in sealing contact with said second member, said body portion extending upwardly at an acute angle to the horizontal and said lip extending downwardly from said body portion, and a mass of foam resin insulation disposed within said cavity and in contact with said strip.

3. The vessel of claim 2, wherein said strip extends completely around the circumference of said first member.

4. The vessel of claim 1, wherein said strip is secured to the outer surface of said tank member and said outer peripheral edge is engaged with the inner surface of said jacket member.

5. The vessel of claim 2, wherein said strip is secured to the inner surface of said jacket member and said lip is engaged with the outer surface of said tank member.

* * * * *

UNITED STATES PATENT AND TRADEMARK OFFICE

CERTIFICATE OF CORRECTION

PATENT NO. : 4,957,097

DATED : September 18, 1990

INVENTOR(S) : JAMES L. CHEVALIER ET AL

It is certified that error appears in the above-identified patent and that said Letters Patent is hereby corrected as shown below:

Col. 4, Line 47, CLAIM 4 Delete "1" and substitute therefor --2--.

Signed and Sealed this

Twenty-second Day of September, 1992

*Attest:*

DOUGLAS B. COMER

*Attesting Officer*

*Acting Commissioner of Patents and Trademarks*